US009587616B2

(12) United States Patent
Minoya et al.

(10) Patent No.: US 9,587,616 B2
(45) Date of Patent: Mar. 7, 2017

(54) INTERNAL COMBUSTION ENGINE IGNITION DEVICE

(71) Applicant: FUJI ELECTRIC CO., LTD., Kawasaki-shi (JP)

(72) Inventors: Yoshiaki Minoya, Matsumoto (JP); Takanori Kohama, Matsumoto (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 1120 days.

(21) Appl. No.: 13/712,623

(22) Filed: Dec. 12, 2012

(65) Prior Publication Data

US 2013/0152910 A1 Jun. 20, 2013

(30) Foreign Application Priority Data

Dec. 15, 2011 (JP) ..... 2011-274058

(51) Int. Cl.

| | |
|---|---|
| ***F02P 9/00*** | (2006.01) |
| ***F02P 5/15*** | (2006.01) |
| ***G05F 3/02*** | (2006.01) |
| ***F02P 3/04*** | (2006.01) |
| ***F02P 17/12*** | (2006.01) |

(52) U.S. Cl.

CPC ..... *F02P 5/15* (2013.01); *F02P 3/0414* (2013.01); *F02P 17/12* (2013.01); *G05F 3/02* (2013.01)

(58) Field of Classification Search

CPC ..... F02P 17/12; F02P 3/0414; F02P 3/0442; G05F 3/02

USPC ..... 123/625, 626, 644; 323/311; 327/205

See application file for complete search history.

(56) References Cited

U.S. PATENT DOCUMENTS

| | | | | |
|---|---|---|---|---|
| 4,241,708 | A * | 12/1980 | Javeri | F02P 5/155 123/406.66 |
| 4,944,281 | A * | 7/1990 | Suquet | F02D 41/20 123/490 |
| 5,075,627 | A * | 12/1991 | Bodig | F02P 17/12 324/384 |
| 6,283,104 | B1 * | 9/2001 | Ito | F02P 15/08 123/637 |
| 6,957,278 | B1 * | 10/2005 | Gallagher | H03K 5/084 323/282 |

(Continued)

FOREIGN PATENT DOCUMENTS

| | | | |
|---|---|---|---|
| JP | 62-279269 | A | 12/1987 |
| JP | 01-104980 | A | 4/1989 |

(Continued)

*Primary Examiner* — David Hamaoui

(74) *Attorney, Agent, or Firm* — Rabin & Berdo, P.C.

(57) ABSTRACT

An internal combustion engine ignition device can determine ignition timing with high precision to perform ignition with high precision even where noise superimposed at the time of rise of current flowing through an ignition coil is generated. In an internal combustion engine ignition device including an output terminal for detecting an internal state such as a coil current, it is possible to prevent generation of pulse noise in the form of chattering at falling and rising edges of a voltage of the output terminal by using a hysteresis comparator, even if noise is superimposed at the time of rise of the coil current. Therefore, a voltage pulse with pulse width of high precision is transmitted to an electronic control unit without the influence of noise, and the ignition timing can be determined properly with high precision.

12 Claims, 15 Drawing Sheets

(56) References Cited

U.S. PATENT DOCUMENTS

| | | | | |
|---|---|---|---|---|
| 7,038,415 | B2 * | 5/2006 | Nakamura | B60H 1/00828 318/432 |
| 7,131,437 | B2 * | 11/2006 | Ando | F02P 3/0552 123/630 |
| 7,530,350 | B2 * | 5/2009 | Oono | F02P 3/0442 123/644 |
| 2008/0006256 | A1 | 1/2008 | Oono et al. | |

FOREIGN PATENT DOCUMENTS

| | | | |
|---|---|---|---|
| JP | 11-201013 | A | 7/1999 |
| JP | 2008-002392 | A | 1/2008 |

* cited by examiner

INTERNAL COMBUSTION ENGINE IGNITION DEVICE

CROSS-REFERENCE TO RELATED APPLICATION

This application claims priority under 35 U.S.C. §119 from Japanese Patent Application No. 2011-274058, filed on Dec. 15, 2011, the entirety of which is incorporated herein by reference.

BACKGROUND OF THE INVENTION

1. Field of the Invention

This invention relates to an internal combustion engine ignition device mounted on various vehicles.

2. Description of the Related Art

Internal combustion engine ignition devices (referred to as igniters) of the prior art often have a hybrid IC (HyIC) type configuration in which: an ignition coil driven by a transistor such as an IGBT, and a switching control circuit having a function of controlling energization, outputting the internal state (ignition operation) or the like of the ignition coil, are combined; a one-chip type configuration in which the two are integrated into the same semiconductor chip; or a multi-chip type configuration in which a switching control circuit is formed as an integrated circuit and combined with an IGBT chip.

As configuration examples of an internal circuit of such an igniter, configurations shown in Japanese Patent Application Laid-Open No. H11-201013 (FIG. 1) and Japanese Patent Application Laid-Open No. 2008-2392 (FIG. 2) are known.

As an output function for showing the internal state of an igniter, an example in which a current flowing through a transistor (energization state of an ignition coil) is detected and output will be described using a block diagram in FIG. 11. In this figure, the connections of each of an igniter 1, an electronic control unit 2 (ECU), an ignition coil 3, a spark plug 4, and a power supply battery 5 (VB) are shown.

In the respective terminals of the igniter 1 mentioned above, a ground terminal G is at ground potential (0 V), the voltage of a switching input terminal S is Vs, the voltage of an output terminal F for coil current detection is Vfo, the voltage of a battery terminal B is VB, and a primary current flowing through a coil drive terminal C is Ic. The output terminal F is a terminal for generating the voltage Vfo (a voltage pulse at L level) for determining whether the primary current Ic is flowing steadily.

The igniter 1 is configured of a switching control circuit 11, a sense IGBT 12 which is a coil driving transistor, a resistor 13, a MOSFET 14 which is an F-output transistor, comparators 15 and 16, and an exclusive OR circuit 17. The F-output transistor refers to a transistor for outputting the voltage Vfo from the output terminal F.

FIG. 12 shows voltage and current waveforms of respective parts illustrating the operation of the igniter 1. The operation will roughly be described using FIG. 11 and FIG. 12. The voltage Vs which is a signal voltage instructing to drive the coil is applied to the switching control circuit 11 which operates on the power supply battery 5 by the electronic control unit 2 via the switching input terminal S. Accordingly, the sense IGBT 12 is driven turned on by an output voltage Vg (a gate voltage) output from the switching control circuit 11, causing the primary current Ic to flow through the ignition coil 3.

Since the resistor 13 (which may also be referred to as sense resistor) is connected to a sense terminal 12*a* of the sense IGBT 12 which outputs a current of several percent or less of the primary current Ic, a sense voltage Vsns is generated. The sense voltage Vsns is compared with reference voltages VH and VL respectively using the comparators 15 and 16.

When the sense voltage Vsns is less than the reference voltage VL, output signals of the comparators 15 and 16 are both at L level, and an output signal of the exclusive OR circuit 17 is at L level. Therefore, the MOSFET 14 which is the F-output transistor is in an off state, and the voltage Vfo of the output terminal F is at H level. In the case where the sense voltage Vsns is between the reference voltage VL and the reference voltage VH, the output signal of the comparator 16 is at H level, and the output signal of the comparator 15 is at L level. Therefore, the output signal of the exclusive OR circuit 17 is at H level, the MOSFET 14 which is the F-output transistor is in an on state, and the voltage Vfo of the output terminal (an F terminal) is at L level. Further, when the sense voltage Vsns exceeds the reference voltage VH, the output signals of the comparators 15 and 16 are both at H level. Therefore, the output signal of the exclusive OR circuit 17 is at L level, the MOSFET 14 returns to an off state, and the voltage Vfo of the output terminal F returns to H level.

During a period in which the primary current Ic is rising, i.e., a period in which the sense voltage Vsns is rising, the voltage pulse at L level is generated in the voltage Vfo of the output terminal F by the MOSFET 14 which is the F-output transistor being turned on, and a voltage at H level is output by the MOSFET 14 being turned off. With this voltage pulse at L level, i.e., by the voltage Vfo of the output terminal F becoming the voltage pulse at L level, the electronic control unit 2 recognizes the generation of the primary current Ic, determines the ignition timing for the igniter 1, and ignites the spark plug.

In order to determine the ignition timing with high precision, a period in which the voltage Vfo of the output terminal F has dropped, i.e., a pulse width W of the voltage pulse at L level, needs to be precise.

The switching control circuit 11 mentioned above has, in addition to a switching control function for the sense IGBT 12, a delay control function for noise reduction, a function of preventing burn of the ignition coil 3 by reducing the level of the output voltage Vg using the sense voltage Vsns to stabilize the primary current Ic (as shown in the waveform in FIG. 12), a timer function by which the application of the voltage Vs is monitored and cut off after a certain period of time has elapsed, or the like. By cutting off the voltage Vs, the spark plug is ignited.

Since the duration of the voltage Vs of the switching input terminal S output from the electronic control unit 2 is controlled upon receiving the voltage pulse of the voltage Vfo of the output terminal F mentioned above, the pulse width W of the voltage pulse of the voltage Vfo of the output terminal F requires high precision in order for the spark plug 4 to be ignited with high precision.

In the case where the sense IGBT 12 is not used and an ordinary IGBT with three terminals (i.e., a collector, emitter, and gate) is used, a similar control is possible by connecting a resistor of low impedance between an emitter terminal and a ground terminal to generate the sense voltage Vsns in a similar manner.

Further, regarding an igniter, Japanese Patent Application Laid-Open No. H1-104980 discloses a method of providing hysteresis at a detection threshold value as a method of preventing malfunction due to noise upon detecting an electrical signal.

As shown in FIG. 11 mentioned above, the internal circuit of the igniter 1 is operated with the ground terminal G as the reference. A transient current of the internal circuit may flow to or from the ground terminal G, such that a transient voltage caused by an impedance component during the current flow causes a fluctuation in a reference potential of the switching control circuit 11, the resistor 13, and the comparators 15 and 16.

The fluctuation in the reference potential is directly superimposed as a noise component also in a signal line in each part of the circuit observed with the ground terminal G as the reference.

A great factor in the fluctuation of the reference voltage is the on-off operation of the MOSFET 14 which is the F-output transistor. When the MOSFET 14 is turned on, a large current flows from a controlled power supply VCC to the ground terminal G via a resistor having a low resistance value of several hundred ohms. Since there are stray inductance and stray capacitance between the controlled power supply VCC and the ground, the MOSFET 14 being turned on or off causes the potential of the ground terminal G to fluctuate and a noise component to be superimposed on the ground potential. With the noise component being superimposed on the ground potential, a waveform of a sense voltage Vsns' as in FIG. 12 appears. Accordingly, pulse noise in the form of chattering is generated in the output of the comparators 15 and 16 due to a comparing operation of the reference voltages VH and VL.

When the pulse noise in the form of chattering is generated, the pulse noise is transmitted via the exclusive OR circuit 17 and the MOSFET 14 which is the F-output transistor, resulting in a waveform of a voltage Vfo' of the output terminal as in FIG. 12. Accordingly, pulse noise in the form of chattering is generated in the voltage pulse at L level at falling and rising edges before and after the voltage pulse at L level is output. When the pulse noise is superimposed, the period (pulse width W) in which there has been drop to the voltage pulse at L level (a Low pulse) is narrowed to a pulse width W'. When the voltage pulse with the narrow pulse width W' is input to the electronic control unit 2, the electronic control unit 2 determines the ignition timing for the igniter 1 erroneously, and the spark plug is not ignited with high precision. That is, an improper determination on the ignition timing by the electronic control unit 2 occurs.

Japanese Patent Application Laid-Open No. H11-201013 (FIG. 1), Japanese Patent Application Laid-Open No. 2008-2392 (FIG. 2), and Japanese Patent Application Laid-Open No. H1-104980 do not describe preventing an improper determination on the ignition timing by using comparing means (a hysteresis comparator) having hysteresis characteristics in an internal combustion engine ignition device in which an on-off control of current for energizing an ignition coil is performed and an output terminal for externally outputting the ignition state is provided, even in the case where noise superimposed at the time of rise of the current flowing through the ignition coil is generated.

SUMMARY OF THE INVENTION

An object of this invention is to solve the problem mentioned above and provide an internal combustion engine ignition device which can determine the ignition timing properly with high precision to perform ignition with high precision even in the case where noise superimposed at the time of rise of current flowing through an ignition coil is generated.

In order to achieve the object mentioned above, a first aspect of the invention provides an internal combustion engine ignition device in which an on-off control of current for energizing an ignition coil is performed by a switching element upon receiving a control signal, and an output terminal for externally outputting an ignition state of the ignition coil is provided. The internal combustion engine ignition device includes voltage converting means for converting the current to a voltage, the converted voltage being referred to as a sense voltage, and first comparing means for comparing the sense voltage with each of two reference voltages, the two reference voltages being a first detection reference voltage for detecting the sense voltage at a time of rise, and a first release reference voltage which is a voltage lower than the first detection reference voltage, to output a first output signal. The first comparing means has a hysteresis characteristic.

The internal combustion engine ignition device further includes second comparing means for comparing the sense voltage with each of two other reference voltages, the two reference voltages being a second detection reference voltage for detecting the sense voltage at a time of rise, and a second release reference voltage which is a voltage lower than the second detection reference voltage and higher than the first detection reference voltage, to output a second output signal. The second comparing means has a hysteresis characteristic.

The internal combustion engine ignition device further includes output means for receiving the first output signal output from the first comparing means and the second output signal output from the second comparing means and for outputting a third output signal, and switch means for controlling a voltage of the output terminal to be turned on or off using the third output signal output from the output means.

A second aspect of the invention includes the first aspect of the invention, wherein the first comparing means is formed of a first hysteresis comparator, the first hysteresis comparator including a first comparator, a first inverter to which an output of the first comparator is input, a second inverter to which an output of the first inverter is input, a first analog switch which connects the first detection reference voltage to a minus terminal of the first comparator, and a second analog switch which connects the first release reference voltage to the minus terminal of the first comparator. The first hysteresis comparator is configured such that the sense voltage is input to a plus terminal of the first comparator, an on-off operation of the first analog switch is caused by an output signal of the first inverter, an on-off operation of the second analog switch is caused by an output signal of the second inverter, the on-off operation of the first analog switch and the on-off operation of the second analog switch are in a reversed phase relationship, and the first analog switch is in an on state when the sense voltage is lower than the first release reference voltage.

A third aspect of the invention includes the first aspect of the invention, wherein the second comparing means is formed of a second hysteresis comparator, the second hysteresis comparator including a second comparator, a third inverter to which an output of the second comparator is input, a fourth inverter to which an output of the third inverter is input, a third analog switch which connects the second detection reference voltage to a minus terminal of the second comparator, and a fourth analog switch which connects the second release reference voltage to the minus terminal of the second comparator. The second hysteresis comparator is configured such that the sense voltage is input to a plus terminal of the second comparator, an on-off operation of the third analog switch is caused by an output signal of the third inverter, an on-off operation of the fourth analog switch is caused by an output signal of the fourth inverter, the on-off operation of the third analog switch and the on-off operation of the fourth analog switch are in a reversed phase relationship, and the third analog switch is in an on state when the sense voltage is lower than the second release reference voltage.

A fourth aspect of the invention includes any one of the first to third aspects of the invention, wherein the voltage converting means is a resistor, the output means is an exclusive OR circuit which outputs a result of exclusive OR of the first output signal output from the first comparing means and the second output signal output from the second comparing means, and the switch means is a MOSFET.

A fifth aspect of the invention includes the first aspect of the invention, wherein the first and second comparing means are formed of first and second hysteresis comparators. The first hysteresis comparator includes a first comparator, a first inverter to which an output signal of the first comparator is input, a second inverter to which an output signal of the first inverter is input, a first analog switch which connects the first detection reference voltage to a minus terminal of the first comparator, and a second analog switch which connects the first release reference voltage to the minus terminal of the first comparator.

The second hysteresis comparator includes a second comparator, a third inverter to which an output signal of the second comparator is input, a fourth inverter to which an output signal of the third inverter is input, a third analog switch which connects the second detection reference voltage to a minus terminal of the second comparator, and a fourth analog switch which connects the second release reference voltage to the minus terminal of the second comparator.

The sense voltage is input to a plus terminal of the first comparator, an on-off operation of the first analog switch is caused by an output signal of the first inverter, an on-off operation of the second analog switch is caused by an output signal of the second inverter, the on-off operation of the first analog switch and the on-off operation of the second analog switch are in a reversed phase relationship. The first analog switch is in an on state when the sense voltage is lower than the first release reference voltage.

The sense voltage is input to a plus terminal of the second comparator, an on-off operation of the third analog switch is caused by an output signal of the third inverter, an on-off operation of the fourth analog switch is caused by an output signal of the fourth inverter, the on-off operation of the third analog switch and the on-off operation of the fourth analog switch are in a reversed phase relationship, and the third analog switch is in an on state when the sense voltage is lower than the second release reference voltage. The first detection reference voltage and the second release reference voltage are the same.

A sixth aspect of the invention includes the first aspect of the invention, wherein the second comparing means is the second comparing means set forth in the third aspect. The first comparing means is formed of an inverting input switching-type comparator in which two minus inputs are switched and used for comparison, and an inverting input switching control circuit which transmits a switching signal to the inverting input switching-type comparator, receives an output signal of the second hysteresis comparator and an output signal of the inverting input switching-type comparator, and receives a signal that is in synchronization with a control signal for turning on or off the switching element for controlling the current of the ignition coil.

A detection reference voltage of the inverting input switching-type comparator is the first detection reference voltage, and a release reference voltage of the inverting input switching-type comparator is at ground potential.

A seventh aspect of the invention includes the first aspect of the invention, wherein the second comparing means is the second comparing means set forth in the third aspect, and the first comparing means is the first comparing means set forth in the sixth aspect. A detection reference voltage of the inverting input switching-type comparator forming the first comparing means and the second release reference voltage of the second hysteresis comparator are the same, and the release reference voltage of the inverting input switching-type comparator is at ground potential.

An eighth aspect of the invention includes the sixth or seventh aspect of the invention, wherein the inverting input switching-type comparator includes a third comparator, a fifth inverter to which an output signal of the third comparator is input, a sixth inverter to which an output signal of the fifth inverter is input, a fifth analog switch which connects the first detection reference voltage to a minus terminal of the third comparator, and a sixth analog switch which connects the first release reference voltage to the minus terminal of the third comparator.

The sense voltage is input to a plus terminal of the third comparator, an on-off operation of the fifth analog switch is caused by an output signal of the inverting input switching control circuit, an on-off operation of the sixth analog switch is caused by a signal which is obtained by inverting an output signal of the inverting input switching control circuit by a seventh inverter, the on-off operation of the fifth analog switch and the on-off operation of the sixth analog switch are in a reversed phase relationship, and the fifth analog switch is in an on state when the sense voltage is at the ground potential.

A ninth aspect of the invention includes any one of the sixth to eighth aspects, wherein the inverting input switching control circuit is a logic circuit formed of an inverter circuit, an AND circuit, and an OR circuit.

A tenth aspect of the invention includes the first aspect of the invention, wherein the first comparing means is formed of a third hysteresis comparator, the third hysteresis comparator including a fourth comparator, a seventh inverter to which an output signal of the fourth comparator is input, an eighth inverter to which an output signal of the seventh inverter is input, a seventh analog switch which connects the first detection reference voltage to a plus terminal of the fourth comparator, and an eighth analog switch which connects the second release reference voltage to the plus terminal of the fourth comparator. The third hysteresis comparator is configured such that the sense voltage is input to a minus terminal of the fourth comparator, an on-off operation of the seventh analog switch is caused by an output signal of the eighth inverter, an on-off operation of the eighth analog switch is caused by an output signal of the seventh inverter, the on-off operation of the seventh analog switch and the on-off operation of the eighth analog switch are in a reversed phase relationship, the seventh analog switch is in an on state when the sense voltage is lower than the second release reference voltage, and the output means is a NOR circuit.

With this invention, it is possible to prevent generation of pulse noise in the form of chattering at falling and rising edges of a voltage Vfo of an output terminal F (voltage pulse at L level) by using comparing means (a hysteresis comparator) having hysteresis characteristics in an internal combustion engine ignition device (igniter) including the output terminal F for detecting an internal state such as a coil current, even if noise is superimposed at the time of rise of the coil current (a sense voltage). Therefore, a proper voltage pulse at L level (with pulse width of high precision) is transmitted to an electronic control unit without the influence of noise, and the ignition timing can be determined properly with high precision.

DETAILED DESCRIPTION

Embodiments of this invention will be described with examples below. In the description below, portions similar to those in the related art will be described briefly, and the technical content relating to this invention will be described in detail.

EXAMPLE 1

Figure 1:
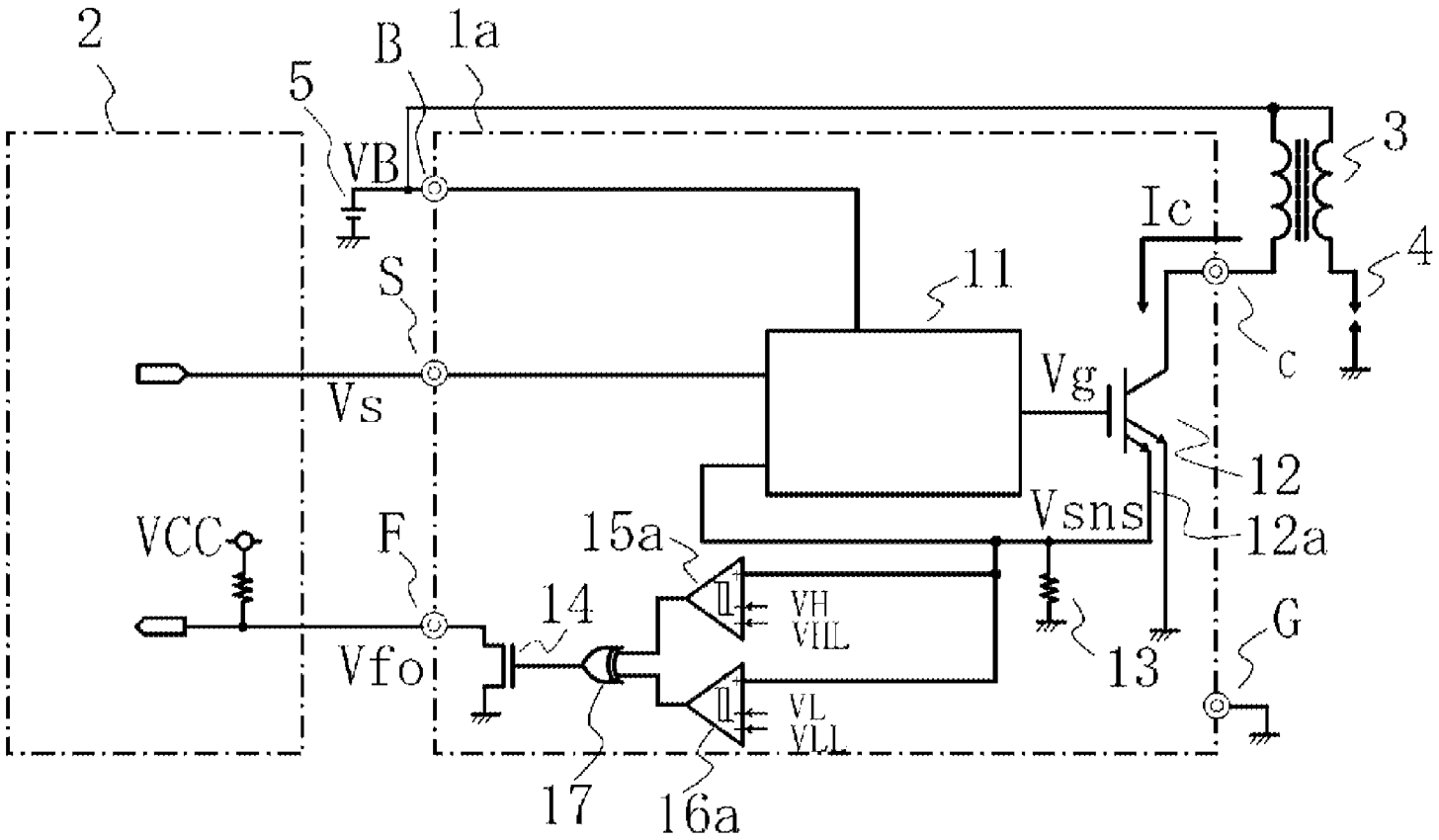
FIG. 1 is a block diagram of an internal combustion engine ignition device in a first example of this invention.
Figure 11:
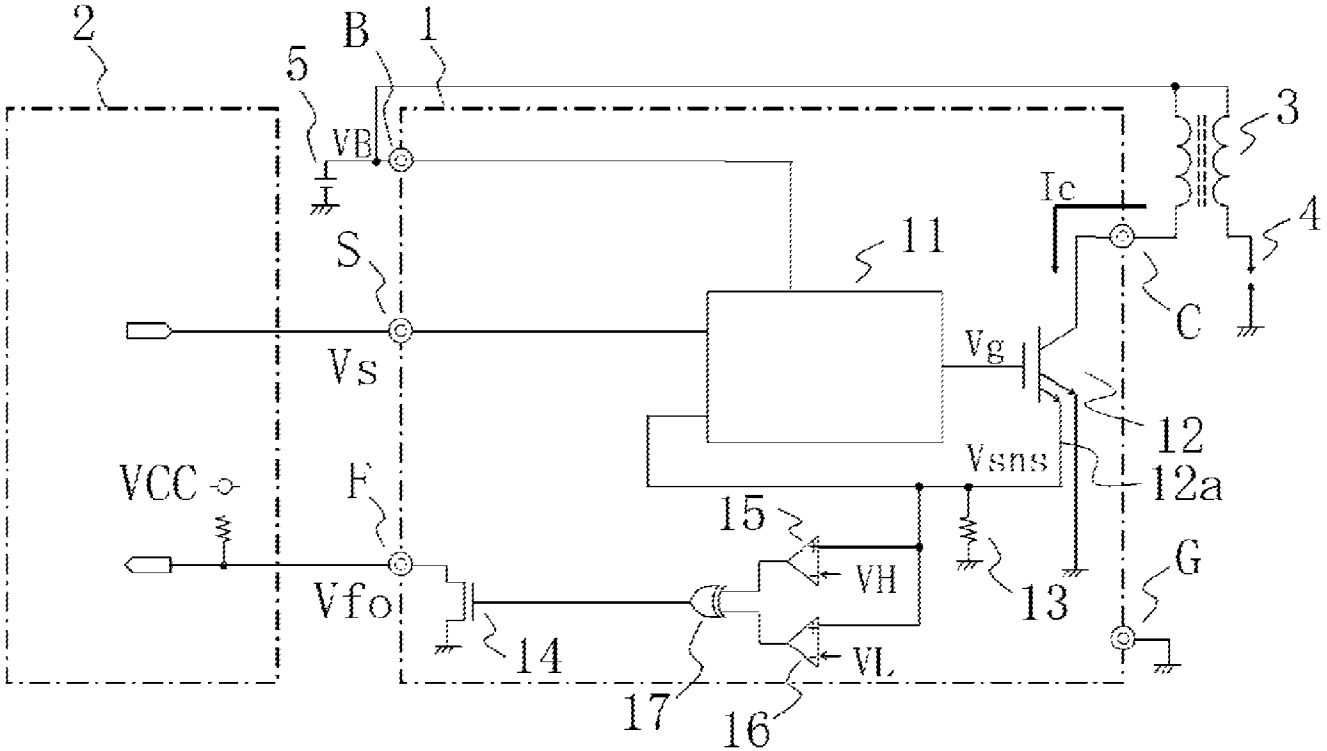
FIG. 11 RELATED ART
FIG. 11 is a block diagram of an internal combustion engine ignition device of the related art.
Figure 12:
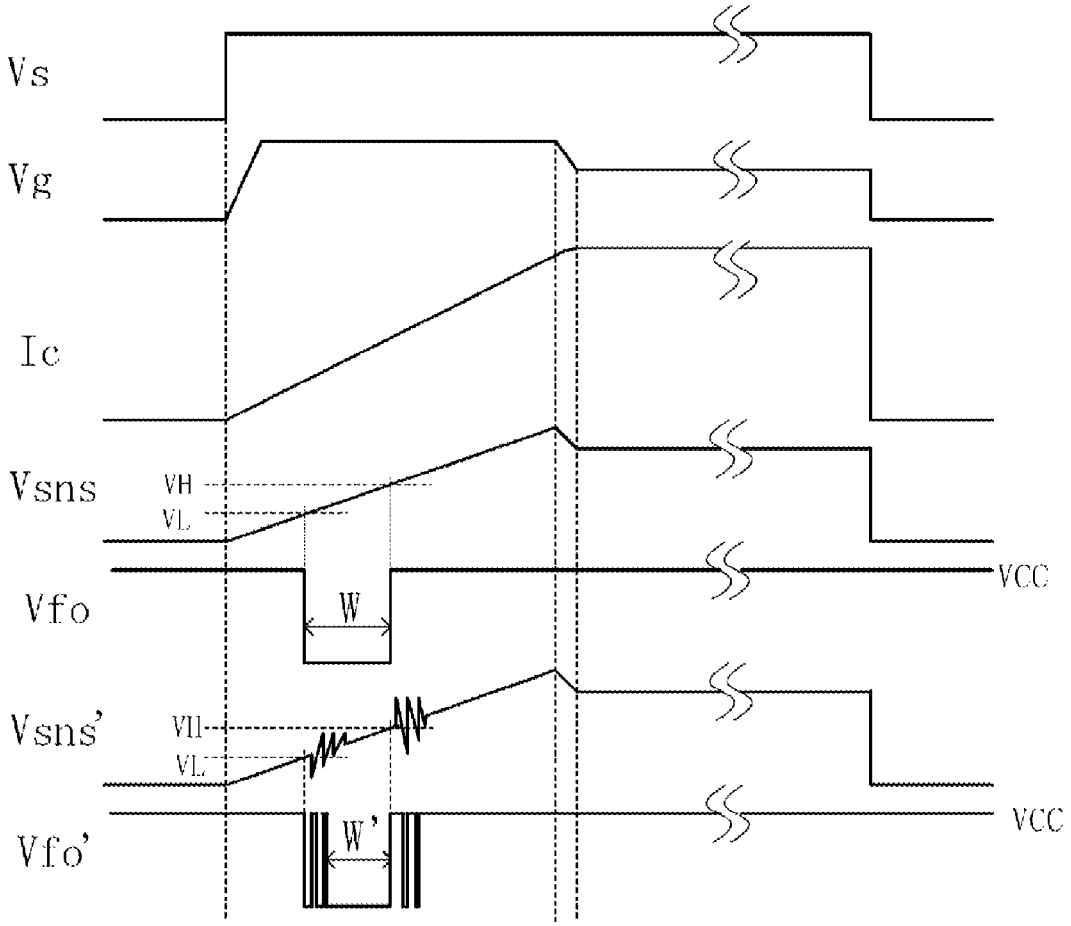
FIG. 12 RELATED ART
FIG. 12 is an operation waveform diagram of the internal combustion engine ignition device in FIG. 11.

FIG. 1 is a block diagram of an internal combustion engine ignition device in a first example of this invention. An internal combustion engine ignition device (igniter) 1*a* has a configuration in which the comparators 15 and 16 in FIG. 11 are respectively replaced by hysteresis comparators 15*a* and 16*a*. Other components are the same as those in FIG. 11.

The hysteresis comparator 15*a* prevents pulse noise in the form of chattering in a high voltage region of a region where a sense voltage Vsns is rising, and the hysteresis comparator 16*a* prevents pulse noise in the form of chattering in a low voltage region of the region where the sense voltage Vsns is rising. The level on the detection side of the hysteresis comparator 15*a* is at a detection reference voltage VH, and the level on the release side is at a release reference voltage VHL. The level on the detection side of the hysteresis comparator 16*a* is at a detection reference voltage VL, and the level on the release side is at a release reference voltage VLL. The magnitude relationship is as follows: VH>VHL>VL>VLL. Note that a hysteresis comparator refers to a comparator in which a detection reference voltage and a release reference voltage lower than the detection reference voltage provide hysteresis characteristics. The sense voltage Vsns and the respective reference voltages are voltages with the ground potential as the reference.

Figure 2A:
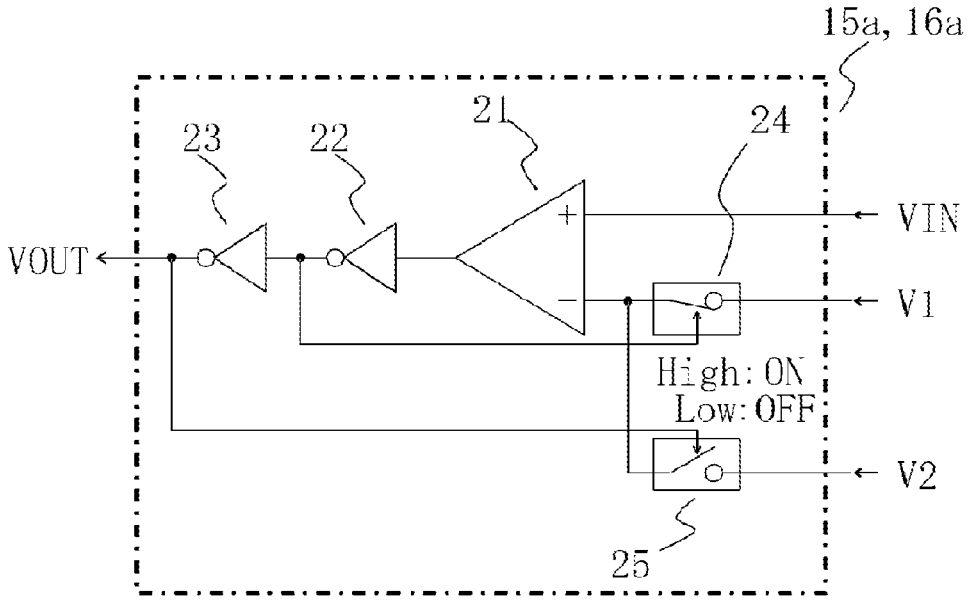
FIGS. 2A and 2B show an internal circuit and input-output transmission characteristics of hysteresis comparators 15*a* and 16*a*, FIG. 2A being an internal circuit diagram of the hysteresis comparators 15*a* and 16*a* and FIG. 2B being an input-output characteristic diagram thereof.
Figure 2B:
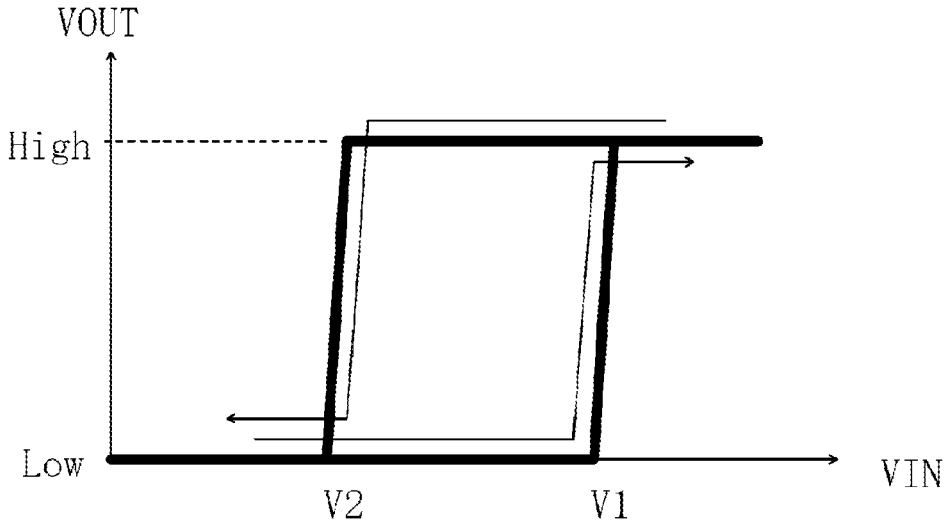

FIGS. 2A and 2B show an internal circuit and input-output transmission characteristics of the hysteresis comparators 15*a* and 16*a*, FIG. 2A being an internal circuit diagram of the hysteresis comparators 15*a* and 16*a* and FIG. 2B being an input-output characteristic diagram thereof. Note that the internal circuits of the hysteresis comparators 15*a* and 16*a* are both the same.

In FIG. 2A, the hysteresis comparators 15*a* and 16*a* include a comparator 21, an inverter 22 to which an output signal (output voltage) of the comparator 21 is input, and an inverter 23 to which an output signal of the inverter 22 is input. Also included are an analog switch 24 for connecting a comparison voltage V1 which is the detection reference voltage to a minus terminal of the comparator 21 and an analog switch 25 for connecting a comparison voltage V2 which is the release reference voltage to the minus terminal of the comparator 21. The sense voltage Vsns is input to a plus terminal of the comparator 21, an on-off operation of the analog switch 24 is caused by the output signal of the inverter 22, and an on-off operation of the analog switch 25 is caused by an output signal of the inverter 23, such that the on-off operations of the analog switches 24 and 25 are in a reversed phase relationship. The analog switches 24 and 25 are both turned ON in the case where a switch switching signal is at High and turned OFF in the case where the switch switching signal is at Low, as shown in FIG. 2B. That is, in both the hysteresis comparators 15*a* and 16*a*, the analog switch 24 is in an on state in the case where an input voltage VIN in FIG. 2B is lower than the comparison voltage V2.

When the input voltage VIN which is the sense voltage Vsns rises and exceeds the comparison voltage V1 in FIG. 2B, output signals VOUT of the hysteresis comparators 15*a* and 16*a* respectively switch from L level (low level) to H level (high level). On the other hand, when the input voltage VIN which is the sense voltage Vsns decreases and becomes less than the comparison voltage V2, the output signals VOUT (output voltages) which are output signals of the hysteresis comparators 15*a* and 16*a* are respectively switched from H level to L level. That is, a hysteresis operation is performed between the comparison voltage V1 and the comparison voltage V2.

The operation will further be described using FIG. 1 and FIGS. 2A and 2B. In the case where the input voltage VIN which is the sense voltage Vsns is lower than the comparison voltages V1 and V2, i.e., VIN<V2<V1, the output signal of the comparator 21 is at L level, the output signal of the inverter 22 is at H level, and the output signal VOUT which is the output signal of the inverter 23 is at L level. Therefore, the analog switches 24 and 25 are respectively in states of on and off. Thus, the comparator 21 at this time performs a comparison operation with the input voltage VIN and the comparison voltage V1.

The output signal VOUT is inverted from L level to H level immediately after detection of the comparison voltage V1 with the input voltage VIN, i.e., in the case where V1<VIN. This is referred to as a comparison operation on a detection side, and the comparison voltage V1 corresponds to the detection reference voltage (VH or VL).

Note that the comparator 21 at this time has switched to a comparison operation of the input voltage VIN and the comparison voltage V2.

Conversely, in a direction of inversion of the output signal VOUT from H level to L level, this is referred to as a comparison operation on a release side, and the comparison voltage V2 corresponds to the release reference voltage (VHL or VLL). Note that the internal configuration is not necessarily fixed as long as input-output characteristics similar to those of the hysteresis comparators 15*a* and 16*a* can be obtained.

Figure 3:
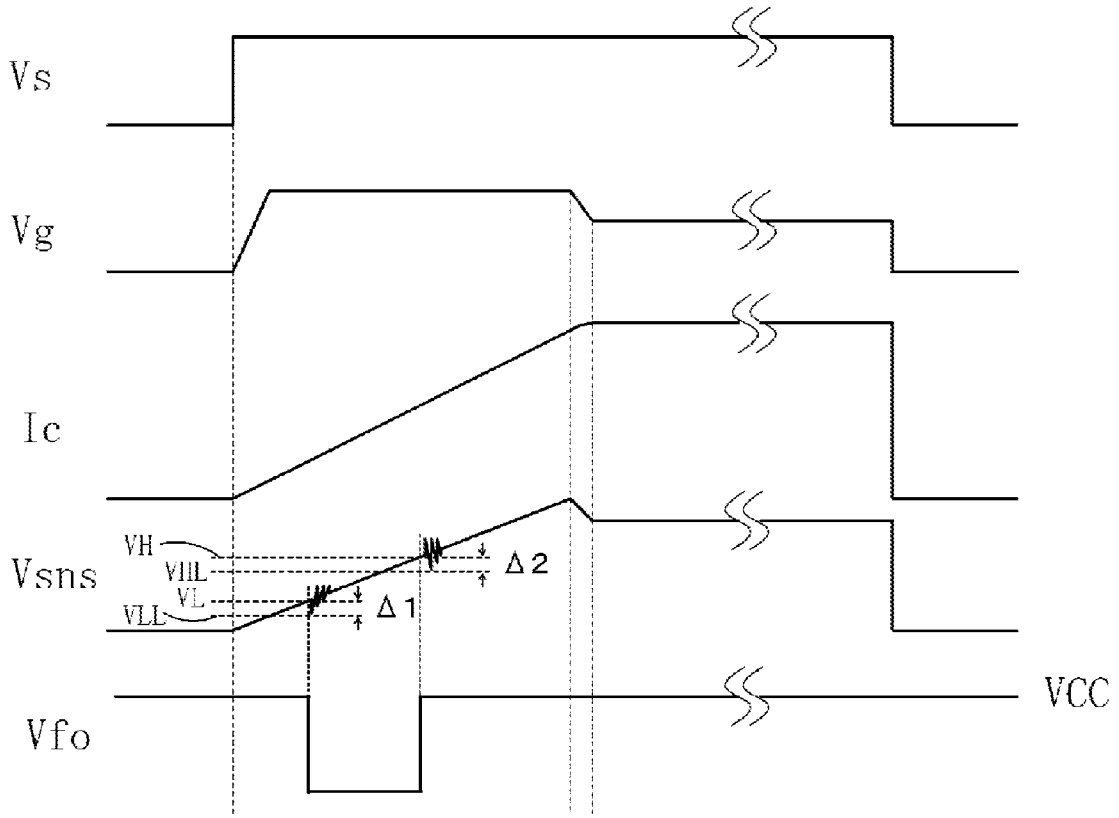
FIG. 3 is a voltage and current waveform diagram of respective parts illustrating the operation in FIG. 1.

FIG. 3 is a voltage and current waveform diagram of respective parts illustrating the operation in FIG. 1. A low voltage region at the rise of the sense voltage Vsns corresponding to a coil current (the primary current Ic) is first compared with the detection reference voltage VL by the hysteresis comparator 16*a*, and, immediately after the output signal thereof is inverted from L level to H level, the hysteresis comparator 16*a* maintains the output at H level without a response when noise superimposed on the sense voltage Vsns is within a range of a hysteresis width of Δ1 which equals the detection reference voltage VL minus the release reference voltage VLL.

Therefore, since the output signal of the hysteresis comparator 15*a* at this time remains at L level, an output signal of the exclusive OR circuit 17 is inverted from L level to be maintained at H level. The MOSFET 14 which is the F-output transistor is switched from an off state to an on state. As a result, the voltage Vfo of the output terminal F is maintained at L level, and pulse noise in the form of chattering is not generated at a falling edge of a voltage pulse at L level.

Next, in a high voltage region at the rise of the sense voltage Vsns, the sense voltage Vsns is first compared with the detection reference voltage VH by the hysteresis comparator 15*a*. Immediately after the output signal thereof is inverted from L level to H level, the hysteresis comparator 15*a* maintains the output at H level without a response when noise superimposed on the sense voltage Vsns is in a range of a hysteresis width of Δ2 which equals the detection reference voltage VH minus the release reference voltage VHL. The output signal of the hysteresis comparator 16*a* at this time remains at H level. Therefore, an output signal of the exclusive OR circuit 17 is inverted from H level to be maintained at L level. The MOSFET 14 which is the F-output transistor is switched from the on state to be maintained in the off state. As a result, the voltage Vfo of the output terminal F is maintained at H level, and pulse noise in the form of chattering is not generated at a rising edge of the voltage pulse at L level.

Thus, pulse noise in the form of chattering is not superimposed at rising and falling edges of the voltage pulse at L level which is the voltage Vfo of the output terminal F, even if noise is superimposed at the time of rise of the sense voltage Vsns. Therefore, since the ignition timing for the spark plug 4 can be determined with high precision, ignition can be performed properly with high precision.

EXAMPLE 2

Figure 4:
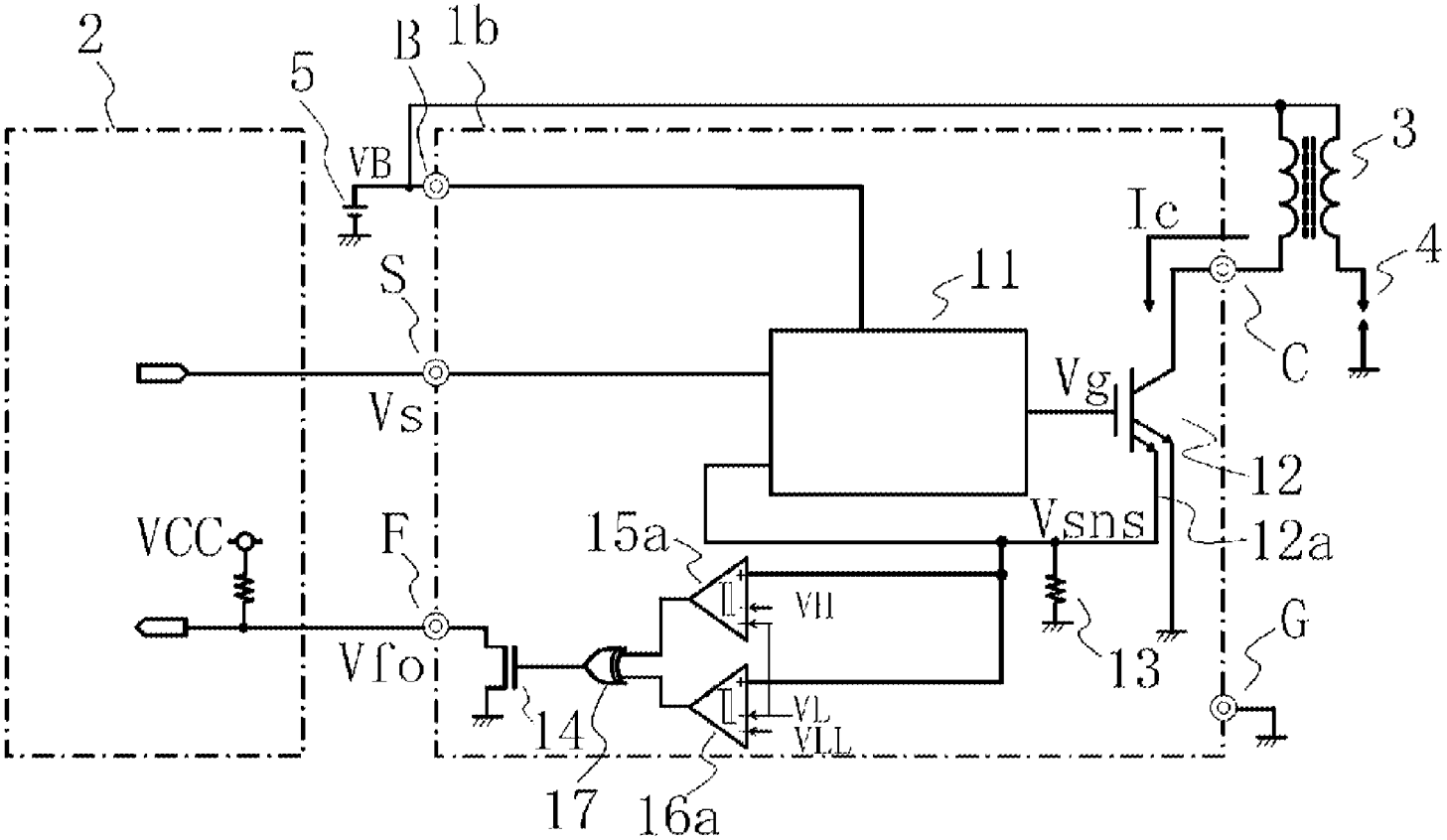
FIG. 4 is a block diagram of an internal combustion engine ignition device in a second example of this invention.

FIG. 4 is a block diagram of an internal combustion engine ignition device in a second example of this invention.

Figure 5:
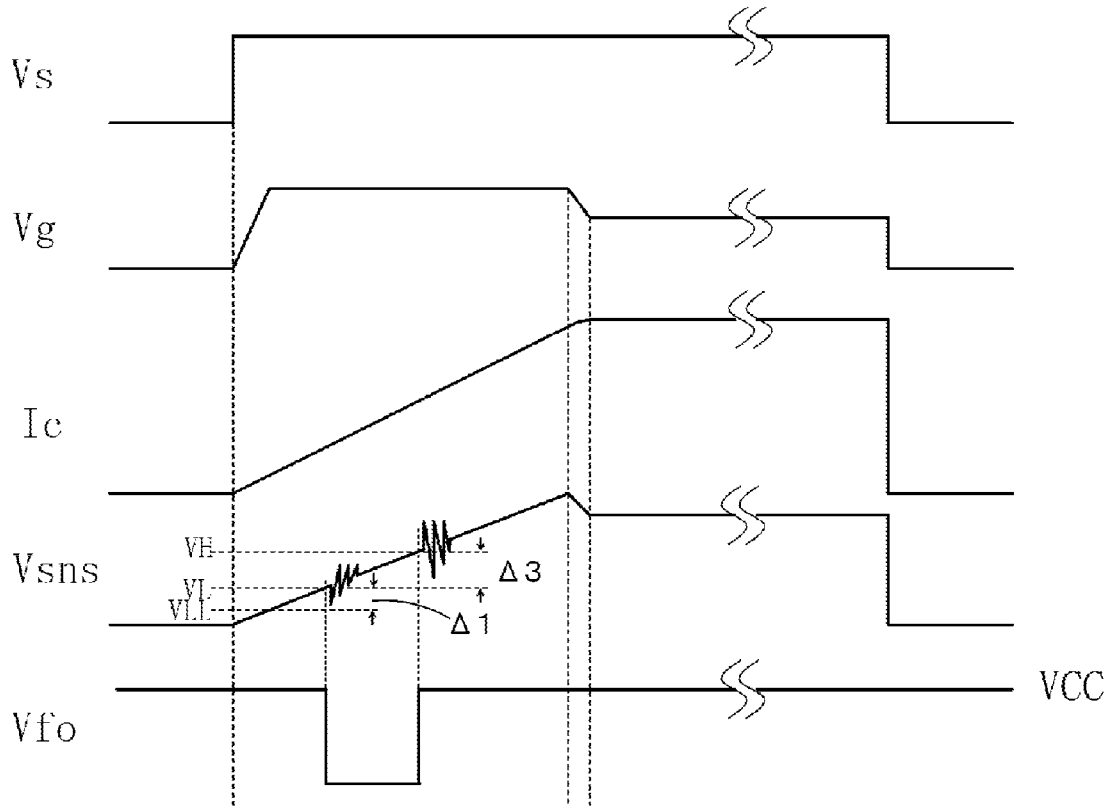
FIG. 5 is an operation waveform diagram of the internal combustion engine ignition device in FIG. 4.

FIG. 5 is an operation waveform diagram of the internal combustion engine ignition device in FIG. 4.

An igniter 1*b* is configured of respective components denoted by the same reference signs as in FIG. 1, but the detection reference voltage VL which is the level on the detection side of the hysteresis comparator 16*a* also serves as the release reference voltage which is the level on the release side of the hysteresis comparator 15*a*. Other configurations are similar to those in Example 1.

Thus, a hysteresis width of the hysteresis comparator 15*a* is Δ3 which equals the detection reference voltage VH minus the detection reference voltage VL, a release reference voltage for only the hysteresis comparator 15*a* is unnecessary, and further a noise margin greater than the hysteresis width of the hysteresis comparator 15*a* in FIG. 1 can be obtained.

As a result, the ignition timing can be determined properly with high precision even in the case where noise superimposed in a high voltage region at the rise of the sense voltage Vsns is large.

EXAMPLE 3

Figure 6:
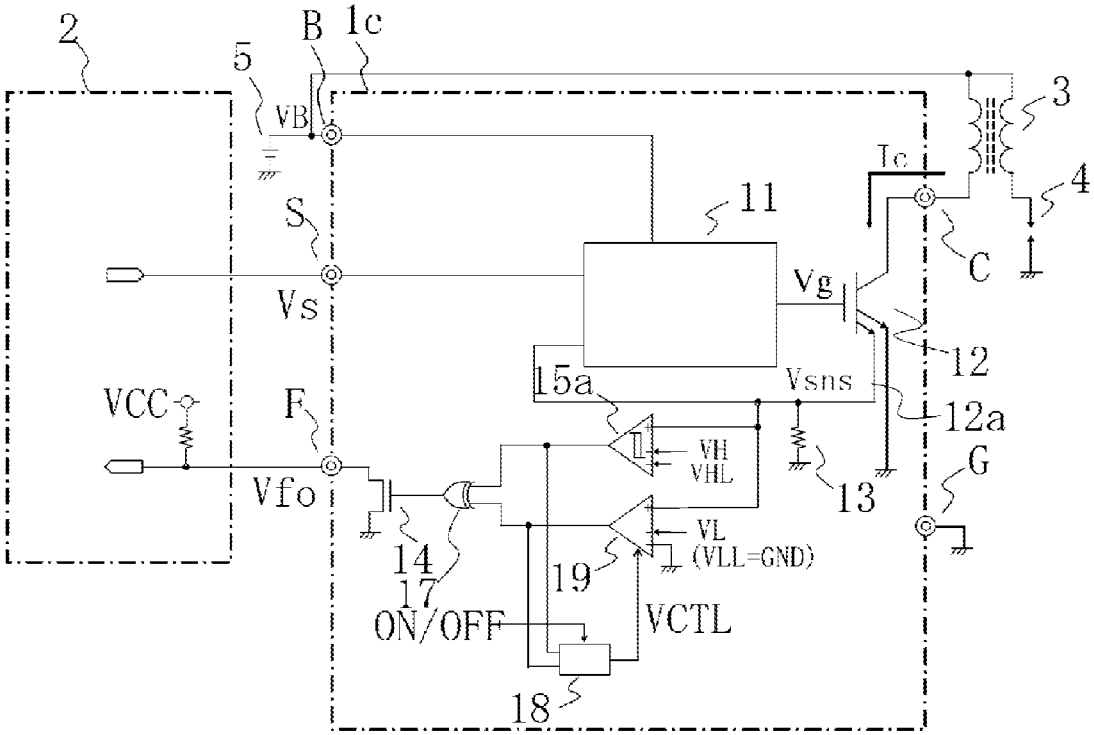
FIG. 6 is a block diagram of an internal combustion engine ignition device in a third example of this invention.
Figure 13:
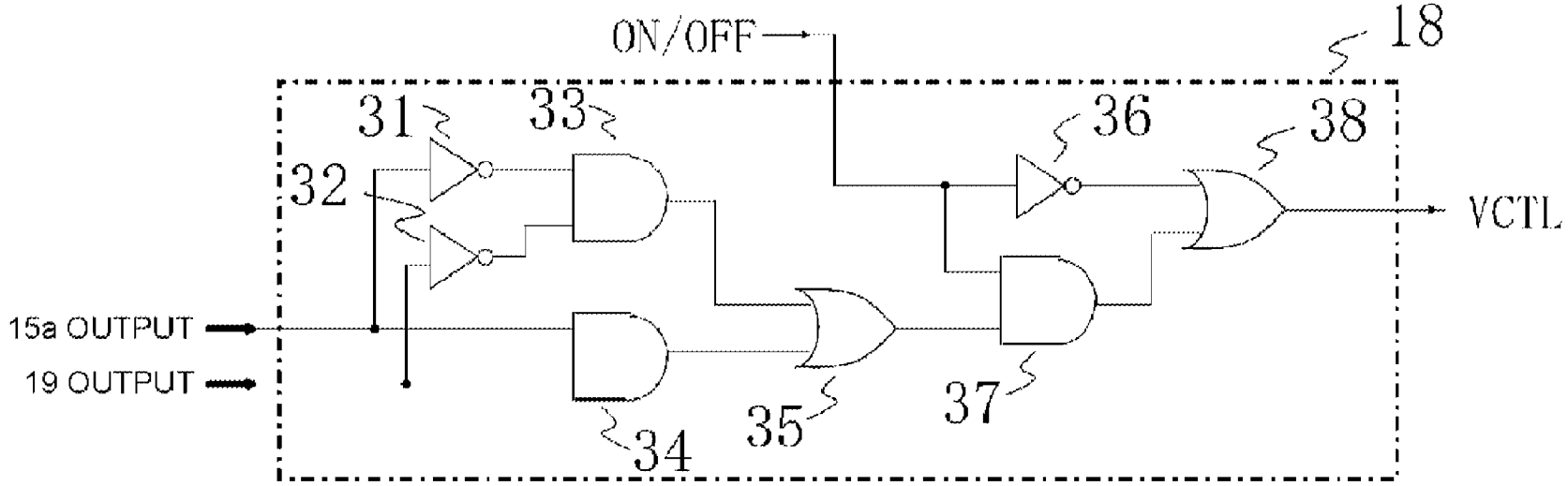
FIG. 13 is an internal circuit diagram of an inverting input switching control circuit 18.

FIG. 6 is a block diagram of an internal combustion engine ignition device in a third example of this invention. In an igniter 1*c*, the hysteresis comparator 16*a* in FIG. 1 is replaced by an inverting input switching-type comparator 19, and an inverting input switching control circuit 18 which controls the inverting input switching-type comparator 19 is added. FIG. 13 is an internal circuit diagram of the inverting input switching control circuit 18, and Table 1 is a truth table for the inverting input switching control circuit 18.

TABLE 1

| ON/OFF SIGNAL | 15a OUTPUT SIGNAL | 19 OUTPUT SIGNAL | OUTPUT SIGNAL VCTL |
|---|---|---|---|
| H level | L level | L level | H level |
| H level | L level | H level | L level |
| H level | H level | L level | L level |
| H level | H level | H level | H level |
| L level | — | — | H level |

ON/OFF SIGNAL: ON/OFF signal shown in FIGS. 6 and 9

15*a* OUTPUT SIGNAL: Output signal of the hysteresis comparator 15*a* shown in FIGS. 6 and 9

19 OUTPUT SIGNAL: Output signal of the inverting input switching-type comparator 19 shown in FIGS. 6 and 9

OUTPUT SIGNAL VCTL: Output signal of the inverting input switching control circuit 18 shown in FIGS. 6 and 9

An input signal of the inverting input switching control circuit 18 is an ON/OFF signal (in synchronization with a sense IGBT being turned on or off) synchronized with output signals of the hysteresis comparator 15*a* and the inverting input switching-type comparator 19 and the output voltage Vg of the switching control circuit 11. An output signal VCTL is obtained with a combinational logic formed of inverters 31, 32, and 36, AND circuits 33, 34, and 37, and OR circuits 35 and 38.

In an initial state immediately after the power is turned on, an OFF signal which is the ON/OFF signal at L level is input to the inverting input switching control circuit 18. In this initial state, the output signal VCTL of the inverting input switching control circuit 18 is at H level regardless of the output signal of the hysteresis comparator 15*a* and the output signal of the inverting input switching-type comparator 19. The output signal VCTL becomes a control signal for selecting one of the reference voltage VL for inverting input and a ground potential reference voltage (VLL which equals GND) of the inverting input switching-type comparator 19. The configuration and operation of the hysteresis comparator 15*a* is similar to the case of Example 1.

Figure 7A:
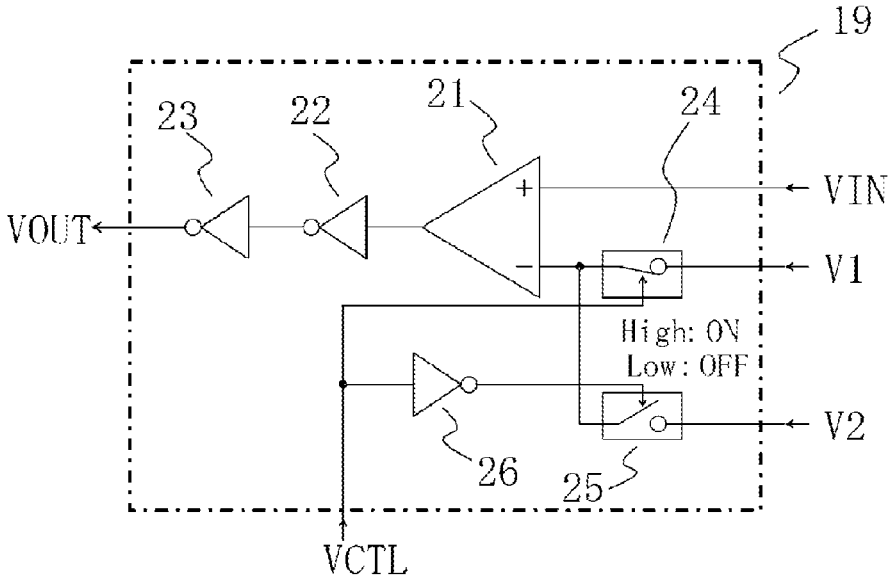
FIGS. 7A and 7B show an internal circuit and input-output operation waveforms of an inverting input switching-type comparator 19, FIG. 7A being an internal circuit diagram and FIG. 7B being a view showing representative examples of the input-output operation waveforms therefor.
Figure 7B:
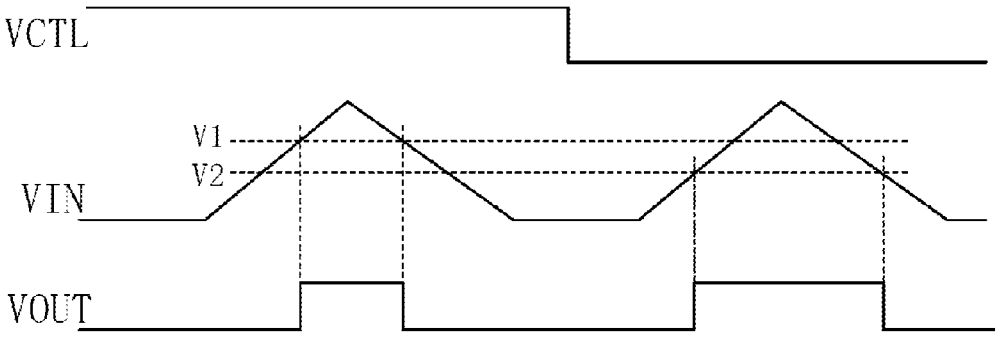

FIGS. 7A and 7B show an internal circuit and input-output operation waveforms of the inverting input switching-type comparator 19, FIG. 7A being an internal circuit diagram and FIG. 7B being a view showing representative examples of the input-output operation waveforms therefor. The difference from the hysteresis comparators 15*a* and 16*a* in FIG. 2A is that an on-off control of the respective analog switches 24 and 25 with the output signals of the inverters 22 and 23 is changed to an on-off control of the respective analog switches 24 and 25 with the output signal VCTL and an output signal of an inverter 26. The analog switches 24 and 25 are both turned ON in the case where the switch switching signal is at High and turned OFF in the case where the switch switching signal is at Low, as shown in FIG. 7B.

Thus, the comparison voltage V1 is selected and used for comparison with the input voltage VIN (corresponding to the sense voltage Vsns) during a period in which VCTL as the output signal of the inverting input switching control circuit 18 and an input signal of the inverting input switching-type comparator 19 is at H level, and the comparison voltage V2 is selected and used for comparison with the input voltage VIN during a period in which the output signal VCTL is at L level. Note that, in the initial state immediately after the power is turned on, the output signal VCTL of the inverting input switching control circuit 18 is at H level as described above, and the comparison voltage V1 is selected in this configuration.

Figure 8:
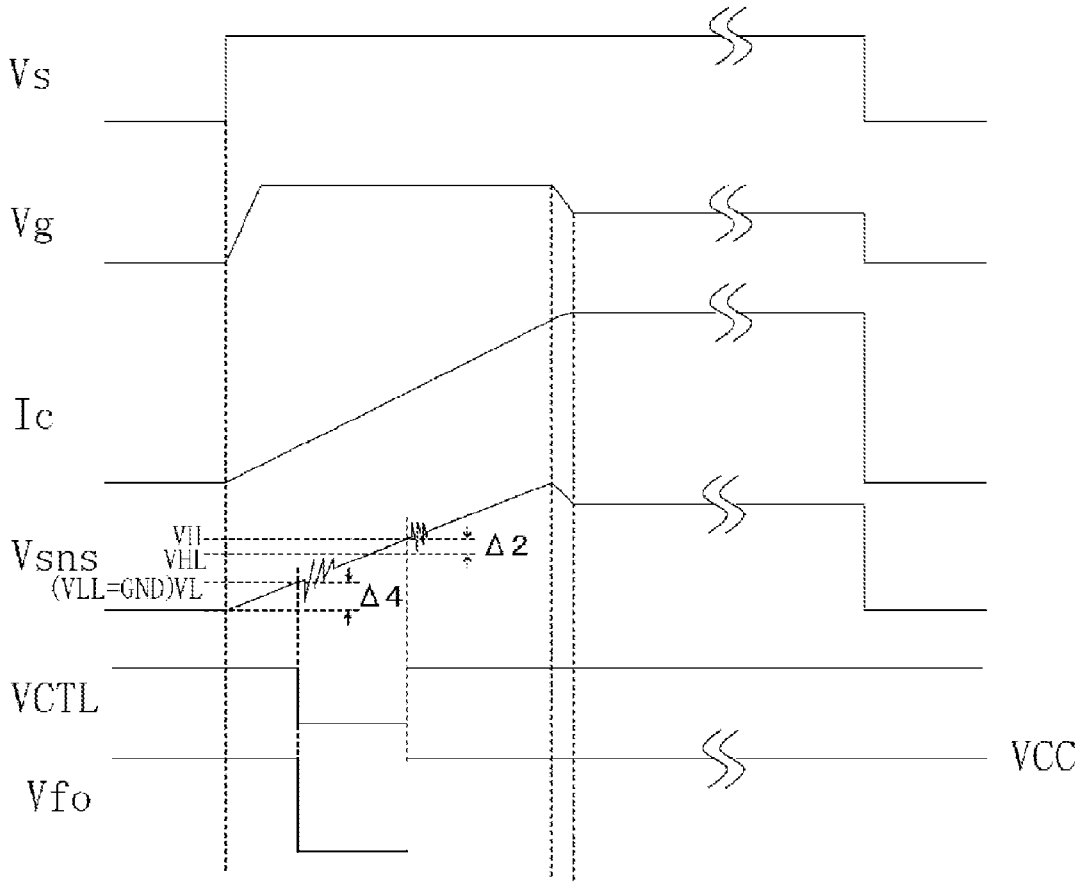
FIG. 8 is a voltage and current waveform diagram of respective parts illustrating the operation in FIG. 6.

FIG. 8 is a voltage and current waveform diagram of respective parts illustrating the operation in FIG. 6. In a low voltage region at the rise of the sense voltage Vsns corresponding to the primary current Ic, the sense voltage Vsns is first compared with the detection reference voltage VL by the inverting input switching-type comparator 19, and an output voltage thereof is inverted from L level to H level. Since the output signal of the hysteresis comparator 15*a* remains at L level, the output signal VCTL of the inverting input switching control circuit 18 is inverted from H level to L level, and a minus input of the comparator 21 within the inverting input switching-type comparator 19 is switched from the detection reference voltage VL to GND level. When noise superimposed on the sense voltage Vsns is within a range of a hysteresis width of Δ4 which equals the detection reference voltage VL minus GND, the inverting input switching-type comparator 19 maintains the output at H level without a response.

Therefore, an output signal of the exclusive OR circuit 17 at this time is inverted from L level to be maintained at H level. The MOSFET 14 which is the F-output transistor is switched from an off state to be maintained in an on state. As a result, the voltage Vfo of the output terminal F is maintained at L level, and pulse noise in the form of chattering is not generated at a falling edge of a voltage pulse at L level.

Next, in a high voltage region at the rise of the sense voltage Vsns, the sense voltage Vsns is first compared with the detection reference voltage VH by the hysteresis comparator 15*a*, and the output voltage thereof is inverted from L level to H level. Since the output signal of the inverting input switching-type comparator 19 remains at H level, the output signal VCTL of the inverting input switching control circuit 18 is inverted from L level to H level, and the minus input of the comparator 21 within the inverting input switching-type comparator 19 is switched from GND to the the detection reference voltage VL. When noise superimposed on the sense voltage Vsns is within a range of a hysteresis width of Δ2, the hysteresis comparator 15*a* maintains the output at H level without a response. The output voltage of the exclusive OR circuit 17 at this time is inverted from H level to be maintained at L level. The MOSFET 14 which is the F-output transistor is switched from the on state to be maintained in the off state. As a result, the voltage Vfo of the output terminal F is maintained at H level, and pulse noise in the form of chattering is not generated at a rising edge of the voltage pulse at L level.

Herein, by providing the hysteresis width for the inverting input switching-type comparator 19 to be Δ4 only during a period in which the output signal VCTL of the inverting input switching control circuit 18 is at L level, a noise margin greater than in the hysteresis comparator 16*a* in FIG. 1 can be obtained.

As a result, the ignition timing can be determined properly with high precision even in the case where noise superimposed in a low voltage region at the rise of the sense voltage Vsns is large.

EXAMPLE 4

Figure 9:
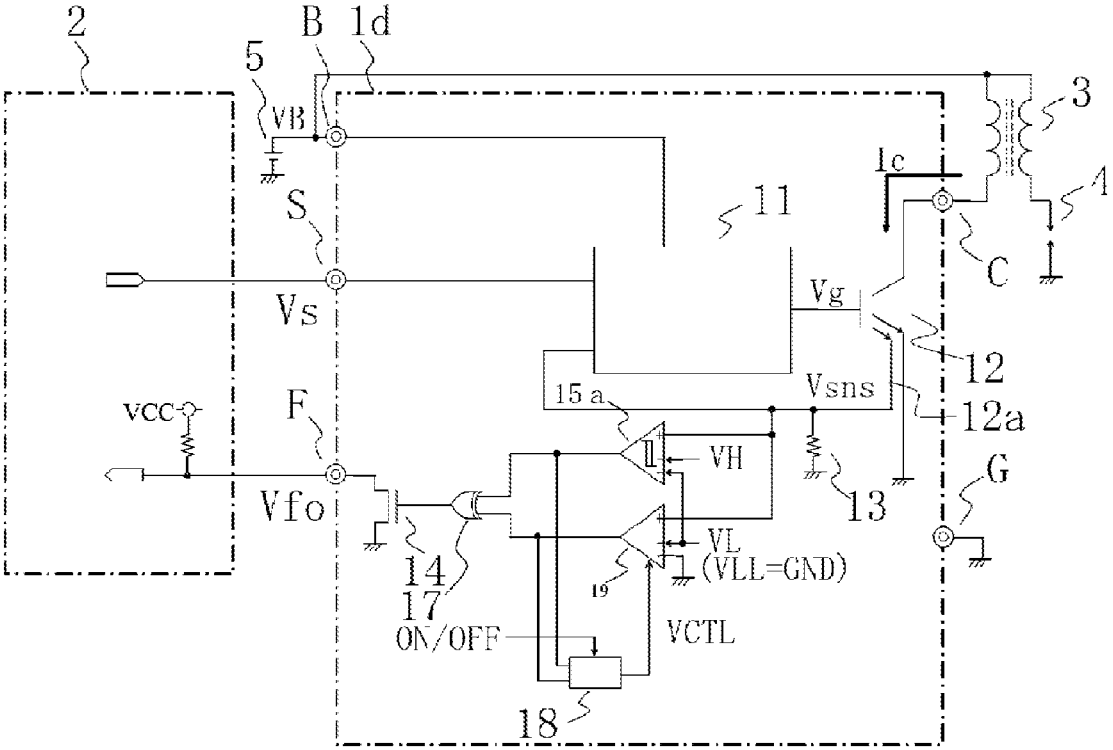
FIG. 9 is a block diagram of an internal combustion engine ignition device in a fourth example of this invention.

FIG. 9 is a block diagram of an internal combustion engine ignition device in a fourth example of this invention.

Figure 10:
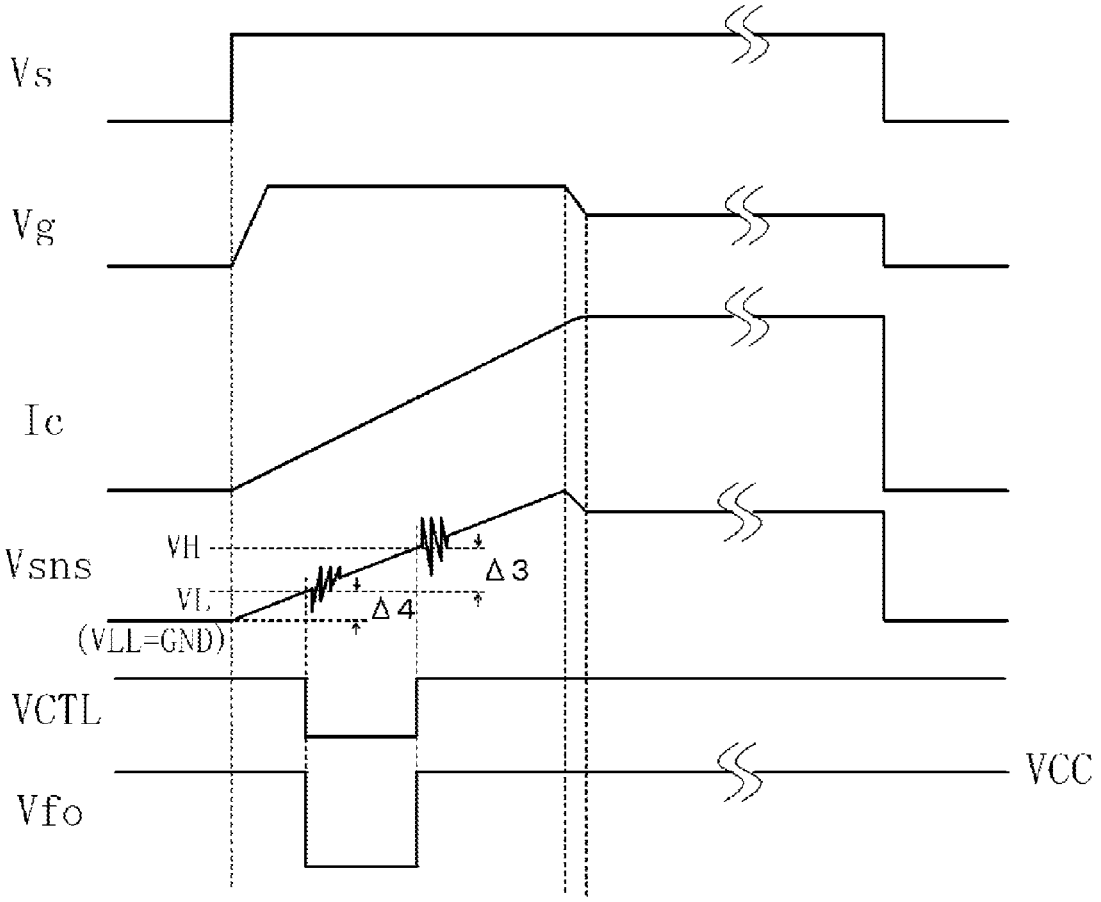
FIG. 10 is an operation waveform diagram of the internal combustion engine ignition device in FIG. 9.

FIG. 10 is an operation waveform diagram of the internal combustion engine ignition device in FIG. 9.

An igniter 1*d* is configured of respective components denoted by the same reference signs as in FIG. 6, but the detection reference voltage VL which is the level on the high-potential side of an inverting input of the inverting input switching-type comparator 19 also serves as the release reference voltage which is the level on the release side of the hysteresis comparator 15*a*. Thus, the hysteresis width of the hysteresis comparator 15*a* is Δ3, a release reference voltage for only the hysteresis comparator 15*a* is unnecessary, and further a noise margin greater than the hysteresis width of the hysteresis comparator 15*a* in FIG. 6 can be obtained.

As a result, the ignition timing can be determined properly with high precision even in the case where noise superimposed in a high voltage region at the rise of the sense voltage Vsns is large.

EXAMPLE 5

Figure 14:
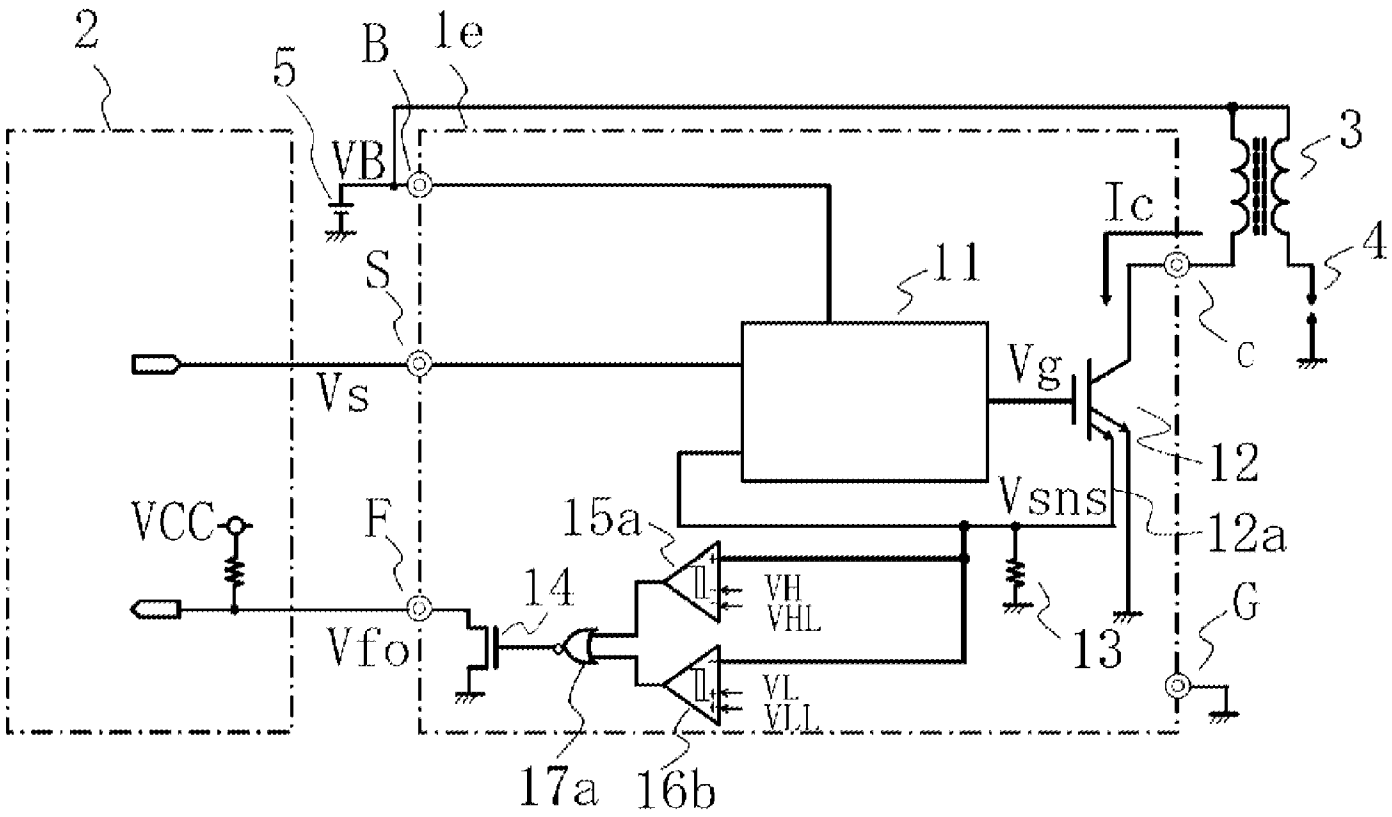
FIG. 14 is a block diagram of an internal combustion engine ignition device in a fifth example of this invention.

FIG. 14 is a block diagram of an internal combustion engine ignition device in a fifth example of this invention.

Figure 15A:
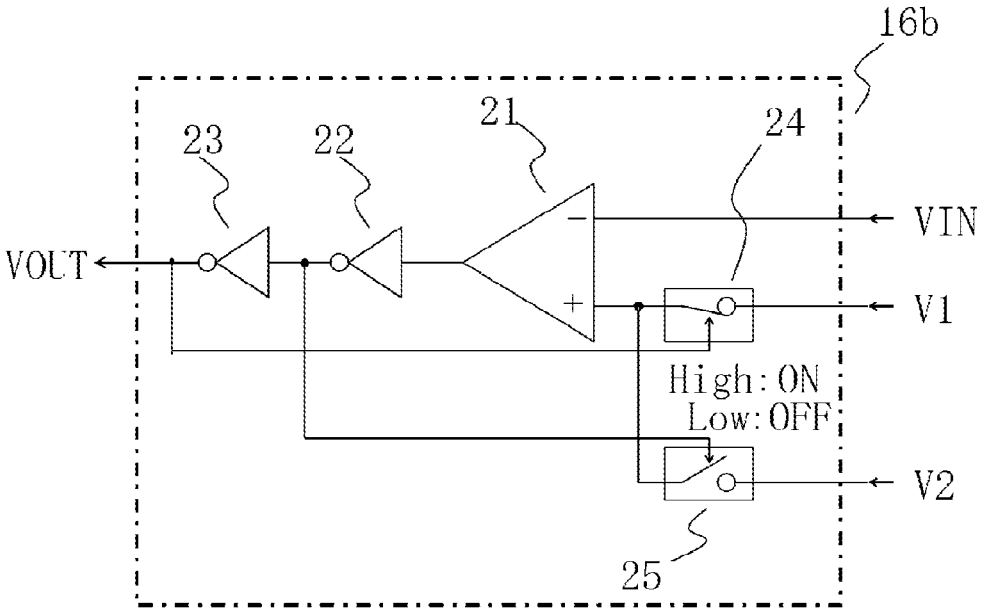
FIGS. 15A and 15B show an internal circuit and input-output transmission characteristics of a hysteresis comparators 16*b*, FIG. 15A being an internal circuit diagram of the hysteresis comparator 16*b* and FIG. 15B being an input-output characteristic diagram thereof.
Figure 15B:
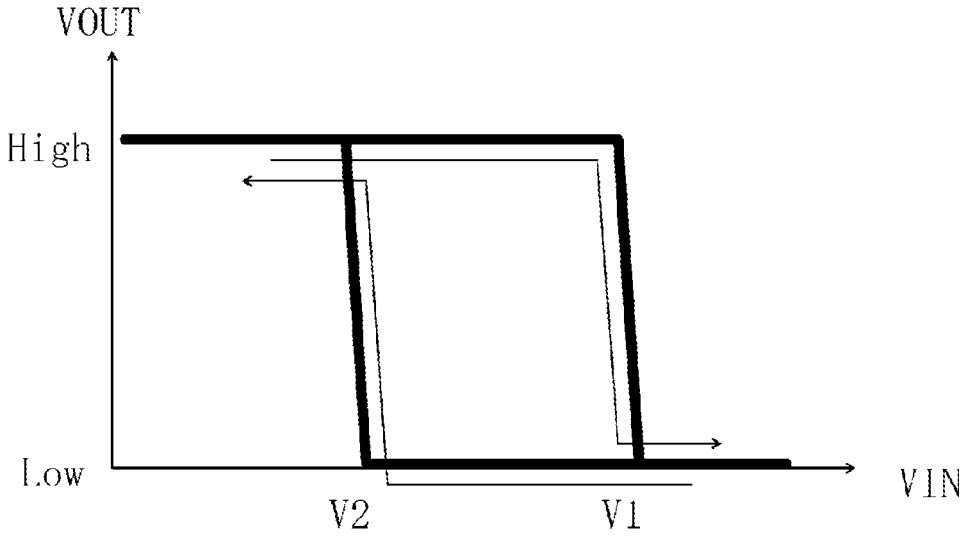

FIGS. 15A and 15B show an internal circuit and input-output transmission characteristics of a hysteresis comparator 16*b*, FIG. 15A being an internal circuit diagram of the hysteresis comparator 16*b* and FIG. 15B being an input-output characteristic diagram thereof.

The difference of an igniter 1*e* in FIG. 14 from the igniter 1*a* in FIG. 1 is that the hysteresis comparator 16*a* is replaced by the hysteresis comparator 16*b*, the exclusive OR circuit 17 is replaced by a NOR circuit 17*a*, the sense voltage Vsns is input to a minus terminal of the hysteresis comparator 16*b*, and the detection reference voltage VL and the release reference voltage VLL are input to two plus terminals.

The operation waveforms of the respective parts are the same as in FIG. 3.

In FIG. 14, the internal circuit of the hysteresis comparator 15*a* is the same as in FIG. 2A, and the sense voltage Vsns is input to a plus terminal of the hysteresis comparator 15*a*. The detection reference voltage VH corresponding to the comparison voltage V1 and the release reference voltage VHL corresponding to the comparison voltage V2 are input to two minus terminals of the hysteresis comparator 15*a*.

The sense voltage Vsns is input to the minus terminal of the hysteresis comparator 16*b*. The detection reference voltage VL corresponding to the comparison voltage V1 and the release reference voltage VLL corresponding to the comparison voltage V2 are input to the two plus terminals of the hysteresis comparator 16*b*.

In FIG. 15A, the hysteresis comparator 16*b* includes the comparator 21, the inverter 22 to which an output signal of the comparator 21 is input, the inverter 23 to which an output signal of the inverter 22 is input, the analog switch 24 which connects the comparison voltage V1 as the detection reference voltage VL to a plus terminal of the comparator 21, and the analog switch 25 which connects the comparison voltage V2 as the release reference voltage VLL to the plus terminal of the comparator 21. The sense voltage Vsns is input to a minus terminal of the comparator 21, an on-off operation of the analog switch 25 is caused by the output signal of the inverter 22, and an on-off operation of the analog switch 24 is caused by an output signal of the inverter 23, such that the on-off operations of the analog switches 24 and 25 are in a reversed phase relationship. The analog switches 24 and 25 are both turned ON in the case where a switch switching signal is at High and turned OFF in the case where the switch switching signal is at Low, as shown in FIG. 15A.

When the sense voltage Vsns which is the input voltage VIN rises and exceeds the comparison voltage V1 (detection reference voltage VL or VH) in FIG. 15B, the output signal VOUT of the hysteresis comparator 15*a* in FIG. 14 switches from L level to H level. On the other hand, the output signal VOUT of the hysteresis comparator 16*b* switches from H level to L level.

When the sense voltage Vsns which is the input voltage VIN decreases and becomes less than the comparison voltage V2 (release reference voltage VHL or VLL), the output signal VOUT of the hysteresis comparator 15*a* in FIG. 14 switches from H level to L level. On the other hand, the output signal VOUT of the hysteresis comparator 16*b* switches from L level to H level. That is, a hysteresis operation is performed between the comparison voltage V1 and the comparison voltage V2.

By inputting the output signal VOUT of the hysteresis comparator 15*a* and the output signal VOUT of the hysteresis comparator 16*b* to the NOR circuit 17*a*, an output signal (voltage) waveform of the NOR circuit 17*a* becomes the same as an output signal (voltage) waveform of the exclusive OR circuit 17 in Example 1.

As a result, pulse noise in the form of chattering is not superimposed at rising and falling edges of the voltage pulse at L level in the voltage Vfo of the output terminal F, even if noise is superimposed at the time of rise of the sense voltage Vsns. Therefore, since the ignition timing for the spark plug 4 can be determined with high precision, ignition can be performed properly with high precision.

While the present invention has been particularly shown and described with reference to certain specific embodiments, it will be understood by those skilled in the art that the foregoing and other changes in form and details can be made therein without departing from the spirit and scope of the present invention.

What is claimed is:

1. An internal combustion engine ignition device, in which an on-off control of current for energizing an ignition coil is performed by a switching element upon receiving a control signal, and an output terminal for externally outputting an ignition state of the ignition coil is provided, the internal combustion engine ignition device comprising:

voltage converting means for converting the current to a voltage, the converted voltage being referred to as a sense voltage;

first comparing means for comparing the sense voltage with each of two reference voltages, the two reference voltages being a first detection reference voltage for detecting the sense voltage at a time of rise and a first release reference voltage which is a voltage lower than the first detection reference voltage, to output a first output signal, the first comparing means having a hysteresis characteristic;

second comparing means for comparing the sense voltage with each of two other reference voltages, the two other reference voltages being a second detection reference voltage for detecting the sense voltage at a time of rise and a second release reference voltage which is a voltage lower than the second detection reference voltage and higher than the first detection reference voltage, to output a second output signal, the second comparing means having a hysteresis characteristic;

output means for receiving the first output signal output from the first comparing means and the second output signal output from the second comparing means and for outputting a third output signal; and switch means for controlling the output terminal to be on or off using the third output signal output from the output means;

wherein the first comparing means is formed of an inverting input switching-type comparator.

2. The internal combustion engine ignition device according to claim 1, wherein the second comparing means is formed of a second hysteresis comparator, the second hysteresis comparator including a second comparator, a third inverter to which an output of the second comparator is input, a fourth inverter to which an output of the third inverter is input, a third analog switch which connects the second detection reference voltage to a minus terminal of the second comparator, and a fourth analog switch which connects the second release reference voltage to the minus terminal of the second comparator, and the second hysteresis comparator being configured such that the sense voltage is input to a plus terminal of the second comparator, an on-off operation of the third analog switch is caused by an output signal of the third inverter, an on-off operation of the fourth analog switch is caused by an output signal of the fourth inverter, the on-off operation of the third analog switch and the on-off operation of the fourth analog switch are in a reversed phase relationship, and the third analog switch is in an on state when the sense voltage is lower than the second release reference voltage.

3. The internal combustion engine ignition device according to claim 2, wherein the first comparing means includes two minus inputs that are switched and used for comparison, and an inverting input switching control circuit which transmits a switching signal to the inverting input switching-type comparator, receives an output signal of the second hysteresis comparator and an output signal of the inverting input switching-type comparator, and receives a signal that is in synchronization with a control signal for turning on or off the switching element for controlling the current of the ignition coil, a detection reference voltage of the inverting input switching-type comparator is the first detection reference voltage, and a release reference voltage of the inverting input switching-type comparator is at ground potential.

4. The internal combustion engine ignition device according to claim 3, wherein the inverting input switching-type comparator includes a third comparator, a fifth inverter to which an output signal of the third comparator is input, a sixth inverter to which an output signal of the fifth inverter is input, a fifth analog switch which connects the first detection reference voltage to a minus terminal of the third comparator, and a sixth analog switch which connects the first release reference voltage to the minus terminal of the third comparator, the sense voltage is input to a plus terminal of the third comparator, an on-off operation of the fifth analog switch is caused by an output signal of the inverting input switching control circuit, an on-off operation of the sixth analog switch is caused by a signal which is obtained by inverting an output signal of the inverting input switching control circuit by a seventh inverter, the on-off operation of the fifth analog switch and the on-off operation of the sixth analog switch are in a reversed phase relationship, and the fifth analog switch is in an on state when the sense voltage is at the ground potential.

5. The internal combustion engine ignition device according to claim 4, wherein the inverting input switching control circuit is a logic circuit formed of an inverter circuit, an AND circuit, and an OR circuit.

6. The internal combustion engine ignition device according to claim 3, wherein the inverting input switching control circuit is a logic circuit formed of an inverter circuit, an AND circuit, and an OR circuit.

7. The internal combustion engine ignition device according to claim 2, wherein the first comparing means includes two minus inputs that are switched and used for comparison, and an inverting input switching control circuit which transmits a switching signal to the inverting input switching-type comparator, receives an output signal of the second hysteresis comparator and an output signal of the inverting input switching-type comparator, and receives a signal that is in synchronization with a control signal for turning on or off the switching element for controlling the current of the ignition coil, a detection reference voltage of the inverting input switching-type comparator forming the first comparing means and the second release reference voltage of the second hysteresis comparator are the same, and the release reference voltage of the inverting input switching-type comparator is at ground potential.

8. The internal combustion engine ignition device according to claim 2, wherein the voltage converting means is a resistor, the output means is an exclusive OR circuit which outputs a result of exclusive OR of the first output signal output from the first comparing means and the second output signal output from the second comparing means, and the switch means is a MOSFET.

9. The internal combustion engine ignition device according to claim 1, wherein the voltage converting means is a resistor, the output means is an exclusive OR circuit which outputs a result of exclusive OR of the first output signal output from the first comparing means and the second output signal output from the second comparing means, and the switch means is a MOSFET.

10. The internal combustion engine ignition device according to claim 7, wherein the inverting input switching-type comparator includes a third comparator, a fifth inverter to which an output signal of the third comparator is input, a sixth inverter to which an output signal of the fifth inverter is input, a fifth analog switch which connects the first detection reference voltage to a minus terminal of the third comparator, and a sixth analog switch which connects the first release reference voltage to the minus terminal of the third comparator, the sense voltage is input to a plus terminal of the third comparator, an on-off operation of the fifth analog switch is caused by an output signal of the inverting input switching control circuit, an on-off operation of the sixth analog switch is caused by a signal which is obtained by inverting an output signal of the inverting input switching control circuit by a seventh inverter, the on-off operation of the fifth analog switch and the on-off operation of the sixth analog switch are in a reversed phase relationship, and the fifth analog switch is in an on state when the sense voltage is at the ground potential.

11. The internal combustion engine ignition device according to claim 7, wherein the inverting input switching control circuit is a logic circuit formed of an inverter circuit, an AND circuit, and an OR circuit.

12. An internal combustion engine ignition device, in which an on-off control of current for energizing an ignition coil is performed by a switching element upon receiving a control signal, and an output terminal for externally outputting an ignition state of the ignition coil is provided, the internal combustion engine ignition device comprising:

a resistor for converting the current to a voltage, the converted voltage being referred to as a sense voltage;

a first hysteresis comparator for comparing the sense voltage with each of two reference voltages, the two reference voltages being a first detection reference voltage for detecting the sense voltage at a time of rise and a first release reference voltage which is a voltage lower than the first detection reference voltage, to output a first output signal;

a second hysteresis comparator for comparing the sense voltage with each of two other reference voltages, the two other reference voltages being a second detection reference voltage for detecting the sense voltage at a time of rise and a second release reference voltage which is a voltage lower than the second detection reference voltage and higher than the first detection reference voltage, to output a second output signal;

an output circuit for receiving the first output signal output from the first hysteresis comparator and the second output signal output from the second hysteresis comparator and for outputting a third output signal; and a switch for controlling the output terminal to be on or off using the third output signal output from the output circuit;

wherein the first hysteresis comparator is formed of an inverting input switching-type comparator.

* * * * *